US005266766A

United States Patent [19]

Hecox

[11] Patent Number: 5,266,766

[45] Date of Patent: Nov. 30, 1993

[54] PROGRESSIVE RADIO FREQUENCY DIELECTRIC OVEN WITH INFRA-RED RADIATION

[76] Inventor: William Hecox, 2470 Sitterly Rd., Canal Winchester, Ohio 43110

[21] Appl. No.: 843,839

[22] Filed: Feb. 28, 1992

[51] Int. Cl.[5] ..... H05B 6/54

[52] U.S. Cl. ..... 219/10.81; 219/10.69; 219/388; 99/451; 99/358; 221/150 A

[58] Field of Search ..... 219/10.81, 10.67, 10.47, 219/10.69, 10.71, 388, 389; 221/150 A; 99/358, 451, DIG. 14, 325

[56] References Cited

U.S. PATENT DOCUMENTS

| | | | |
|---|---|---|---|
| 2,413,003 | 12/1946 | Sherman | 219/10.81 |
| 2,546,004 | 3/1951 | Kinn | 219/10.81 |
| 4,775,769 | 10/1988 | Jones | 219/10.81 |
| 4,812,609 | 3/1989 | Butot | 219/10.81 |
| 4,974,503 | 12/1990 | Koch | 99/451 |
| 4,999,468 | 3/1991 | Fadel | 219/10.55 A |

*Primary Examiner*—Philip H. Leung

*Attorney, Agent, or Firm*—Francis T. Kremblas, Jr.

[57] ABSTRACT

A multiple stage oven structure including a radio frequency cooking station and an infra-red cooking station particularly useful for cooking certain food products. The radio-frequency cooking station comprises a first and second electrode and a conveyor to position the food product between the electrodes wherein it is the dielectric material of a capacitive heating assembly. Also disclosed is an automated food cooking and serving arrangement incorporating the multiple stage oven structure with a food storage section and associated conveyors and electronic control components for conveying the food product through various steps of selection, cooking and delivery of the cooked product to a customer. In a preferred arrangement, the food product is carried by an electrically conductive pan which functions as the second electrode in the radio-frequency cooking station assembly, forms a portion of a radio frequency shield during cooking, and as a serving pan once cooking is completed.

7 Claims, 3 Drawing Sheets

PROGRESSIVE RADIO FREQUENCY DIELECTRIC OVEN WITH INFRA-RED RADIATION

TECHNICAL FIELD

The present invention relates generally to oven constructions useful for cooking natural, deep frozen and/or pre-cooked foods. More particularly, the present invention relates to oven structure and associated components well-suited for cooked food dispensing apparatus.

BACKGROUND ART

There are many types of well-known food cooking ovens which use gas combination, microwaves, or infra-red heat sources and some which disclose a combination thereof useful for cooking deep frozen, refrigerated or pre-cooked food. One example is found in U.S. Pat. No. 4,999,468.

While microwave heating sources are useful to quickly heat food, there are disadvantages for using such a source in a combination, progressive heating source oven. One disadvantage is the requirement of shielding the microwave energy which requires a special structure to isolate such a heating station from the remaining heating station or stations and the surrounding environment while permitting access in and out of the shielded area. Further, metal food pans in which a product is cooked and delivered pose a problem in a microwave oven. Additionally, microwave energy tends to heat the food product in a less uniform manner and therefore a substantial portion of the heat energy is transferred to the food by conduction. Conventional infra-red sources needed to brown the outside of a food product operate in a similar manner relative to requiring conduction to heat the inside of the product, however, are useful to brown or crisp the outside.

The construction of an efficient microwave oven requires the use of wave guides or resonant chambers and often moving parts to more uniformly apply heat energy. These factors further complicate the construction of a more simple and less expensive multiple, progressive heat source oven structure and the manner in which such may be conveyed between multiple heating stations.

As applied to an automated food cooking dispenser for pizza for example, wherein a frozen or refrigerated pizza type food must be fully and properly cooked as quickly as possible, it is desirable to initially heat the food portion uniformly as fast as possible and then subject it to an infra-red source for browning or crisping the outside of the food. While microwave energy has been suggested for the initial heating and cooking stage, its disadvantages make it less than fully satisfactory to construct and operate in connection with a second or final stage infra-red cooking source to obtain an efficiently cooked food portion in the shortest practical time.

Prior to the present invention, radio-frequency energy has long been used for certain industrial heating applications, however, it has not been used in the cooking of foods or in combination with infra-red sources to construct a fast and efficient multiple stage or progressive food cooking oven. Radio frequency heating as used herein refers to the type wherein a pair of spaced electrodes having a dielectric material between is employed to form a capacitor through which a uniform high frequency field is passed to cause a molecular action to take place through out the cross-section of the dielectric material. It specifically does not include micro-wave heating as it is generally known and used in conventional ovens which employ relative higher frequencies and shorter wave lengths to attempt to efficiently heat the product.

SUMMARY OF INVENTION

The present invention relates to a new and improved food oven construction and particularly relates to a novel combination using radio frequency (RF) heating in progressive combination with infra-red heating to cook natural food products. More particularly, this novel food cooking structure is well-adapted for use in automated food cooking dispensers for pizza and other suitable food products.

In accordance with the present invention, a food cooking oven is provided which incorporates RF energy to heat and cook foods in a novel manner incorporating relatively simple structure to provide the ground electrode portion of the device which cooperatively functions as a shield preventing escape of the RF waves from the oven structure.

As one aspect of the present invention, an electrically conductive food pan, such as aluminum foil, can be advantageously employed to support the food product, function as the second or ground electrode in the RF heating arrangement, and also provide part of the RF shield to contain the RF waves within the intended cooking area.

As a further aspect of the resent invention, RF heating can be employed to more efficiently heat certain types of food products more quickly than other conventional food cooking heat sources and advantageously employ a metallic food pan in which the cooked food may be served.

As another aspect of the present invention, the RF heating source permits improved control of the heat energy transferred to the food product and a more uniform heating of the food product.

As another aspect of the present invention, a combination RF heat source and an infra-red heat source are utilized in a convenient oven structure provided with means to transfer food portions from a refrigerated compartment into a plurality of cooking stations to permit making a more economically constructed automated cooked dispensing machine.

In one preferred embodiment of the present invention, a vertical conveyor means raises a food carrying electrically conductive pan from a rotary conveyor into a cooking position cooperating with a first electrode. The pan is moved into cooperative engagement with a portion of the RF cooking station in a manner to function as the ground electrode and an RF shield with the food forming the dielectric material of the capacitor formed between the two electrodes. The conveyor, after an interval of RF heating, then returns the pan to the rotary conveyor for transfer to an infra-red cooking station for browning or crusting of the outer surface of the food.

In the disclosed preferred embodiment, appropriate microprocessors and associated circuit components form a logic control circuit to coordinate the movement of the food pan, via both vertical and horizontal conveying means, with the controls for the heating sources to assure proper cooking of the food product.

It is therefore a primary object of the present invention to provide a novel food cooking oven which combines RF heating and infra-red heating in a manner to quickly and efficiently cook natural food products in an economical manner particularly well-suite for automated food dispensing devices.

DETAILED DESCRIPTION

Figure 1:
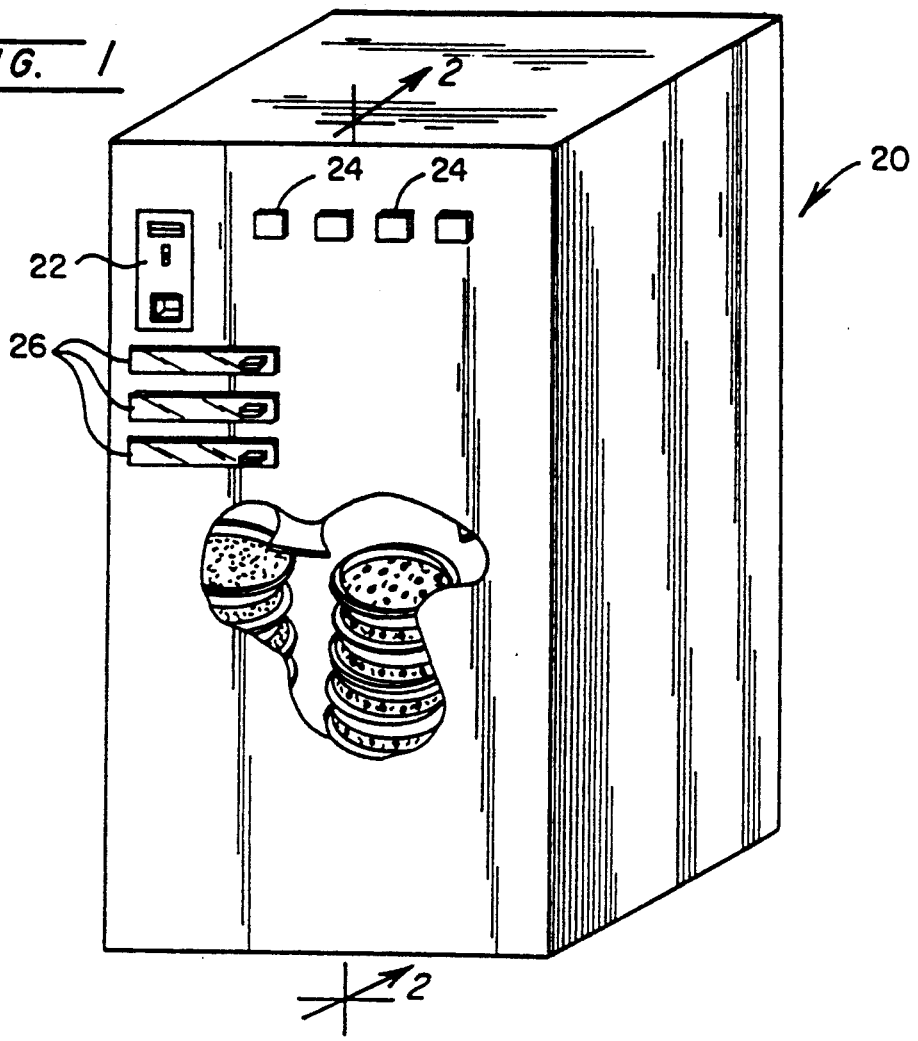
FIG. 1 is a perspective view of an automated food dispensing apparatus in which a combination of RF and infra-red heat sources may be usefully employed in accordance with the present invention.

An automated cooking and food dispenser provided with a combined RF and infra-red cooking oven constructed in accordance with the present invention is shown in FIG. 1 and includes an outer box-like housing, indicated generally at 20, for dispensing of cooked food products, such as pizza for example.

Housing 20 may be provided with a conventional coin-slot receiving device 22, indicator lights such as 24, and dispensing opening 26 for the customer to access the food portion ordered. The coin-slot receiver and indicator lights may be operatively connected in a well-known manner to an electronic logic circuit which controls the operation of the apparatus. Such circuitry and necessary components are well-known to those skilled in the art and therefore are not necessary to describe in detail for a complete understanding of the present invention.

Figure 2:
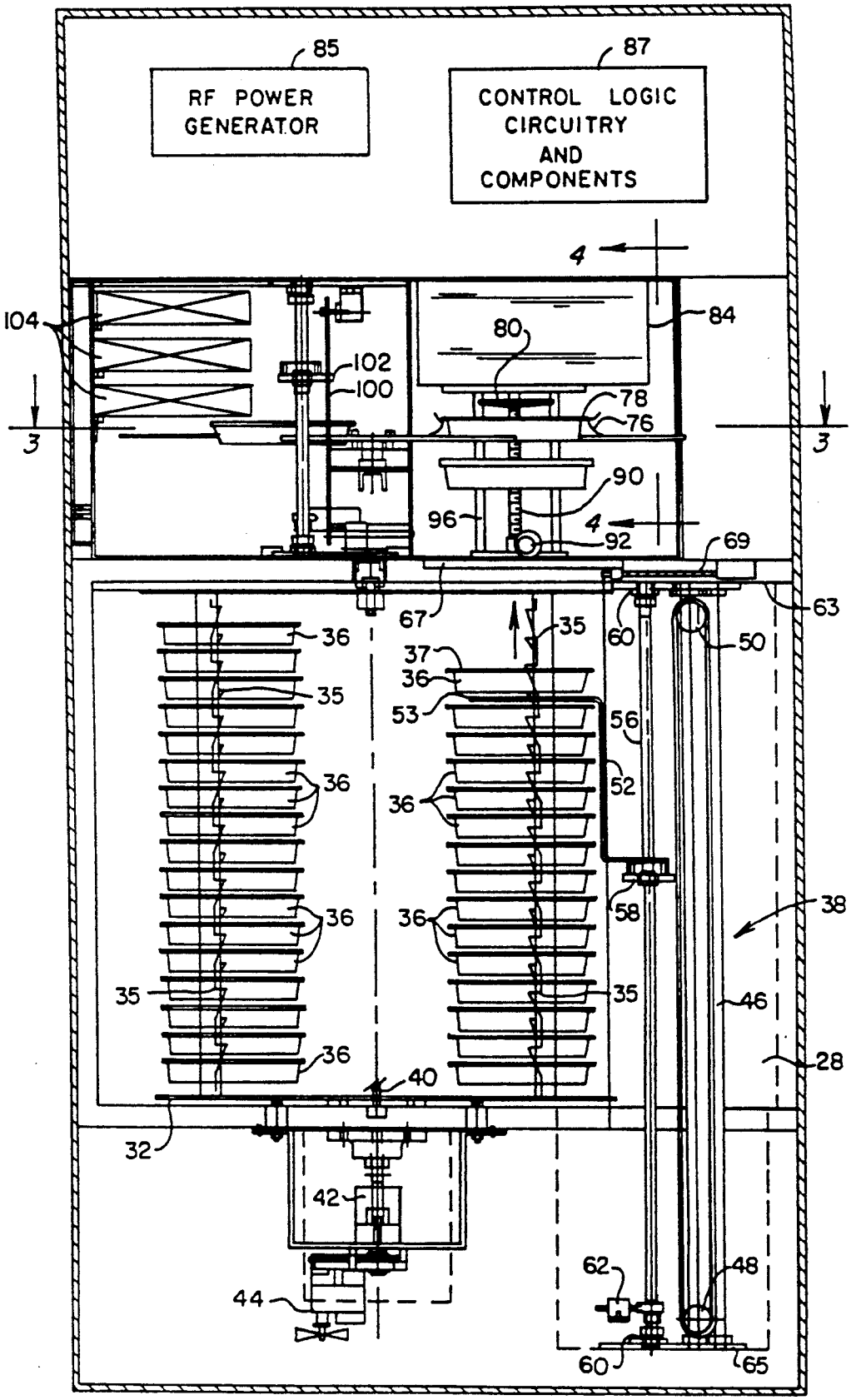
FIG. 2 ia a side sectional view of the apparatus shown in FIG. 1, the section being taken along line 2—2 in FIG. 1.

Housing 20, as seen in FIG. 2, preferably includes at least a first refrigerated food storage compartment indicated generally at 28, and a second oven or cooking compartment indicated generally at 30. The refrigeration of storage compartment 30 is generally required for storing a perishable or frozen food for a reasonable length of time and may be accomplished in any conventional well-known manner, the details of which are not shown and standing alone form no part of the present invention.

In the preferred embodiment shown in FIGS. 1 and 2, storage compartment 28 includes a rotary conveyor means in the form of a carousel type, rotating platform or spider 32 provided with a plurality of vertical supports 34. Preferably, at least three circumferentially spaced supports 34 provided with spring-biased retaining clips, such as 35, form means to carry a plurality of vertically spaced food pans, such as at 36, carrying a pizza food portion in a vertical stack. Each vertical stack of pans 36 is circumferentially spaced from one another such that each stack may be selectively and rotatably positioned or indexed adjacent to an elevator means, indicated generally at 38.

The platform or spider 32 is operable connected to a driven shaft 40 which in turn is connected to a conventional gear driver 42. Gear driver 42 is selectively driven by a conventional electric motor 44 such that the rotation of spider 32 is controlled to turn through a selected arc to accurately position a given vertical stack of food pans 36 adjacent elevator means 38.

Elevator means 38 comprises a conventional endless chain 46 mounted between a driven sprocket 48 and an idler sprocket 50. A paddle-like arm 52 is fixed to a rotatable guide rod 56 which is mounted between bearings 60 and conventionally driven by a suitable electric motor 62. The upper bearing 60 is mounted to an upper wall portion 63 separating chamber 28 from chamber 30 and a mounting plate 65 fixed to a side wall of housing 20. Plate 65 may also serve as a mounting surface for drive sprocket 48 and a drive motor therefor, 51 shown in FIG. 3.

Figure 3:
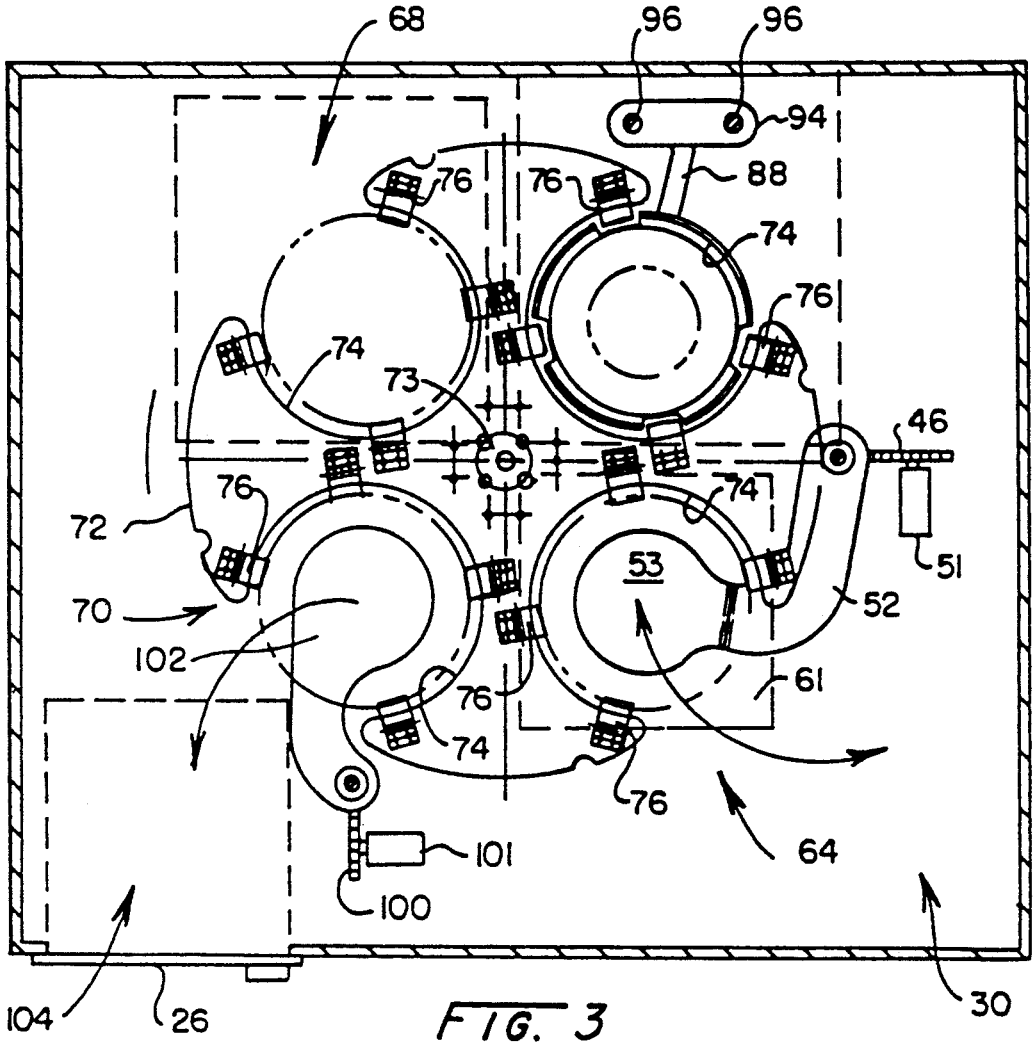
FIG. 3 is a partial top plan sectional view of the apparatus shown in FIG. 2 illustrating the upper rotary conveying means for moving food pans through a cooking cycle, the section taken along line 3—3 in FIG. 2.

Paddle-like arm 52, having an upper horizontally extending portion 53 best seen in FIG. 3, is normally in a position rotated about ninety degrees from that shown in FIGS. 2 and 3, until actuated to move to a level coordinated with the height of the stack of food pans 36 to position upper portion 53 of arm 52 at a level closely adjacent to the bottom of the uppermost food pan 36 in the vertical stack of pans positioned adjacent to elevator means 38. This may be accomplished in various conventional manners, such as through the use of an optical or vernier sensing means, not shown, connected to move with arm 52 which senses the lip of the uppermost food pan in a stack and provides an electrical signal to the drive motor to stop the motion of chain 44 and actuate arm 52 to rotate to the position seen in FIG. 2 directly under the uppermost food pan 36.

Upon receiving another control signal from the logic circuit, chain 46 may be caused to move to raise arm 52 to engage the bottom of a pan 36 with the horizontal portion 53 and carry the pan upwards through an opening 61 in wall portion 64 to the cooking compartment 30 to a loading station described in greater detail later herein. Preferably, opening 61 is normally closed by a sliding door arrangement 67 which is conventionally driven by an electric motor and worm screw assembly 69, however, other conventional arrangements could be usefully employed without departing from the present invention. Upon receiving an appropriate signal coordinated with the positioning of arm 52 under a pan 36, door 67 is caused to slide to an open position.

Retaining clips 35 are configured to engage food pans in a toggle-like manner limiting downward movement and to free them upon exerting sufficient force in an upward direction to overcome the bias of the spring force between circumferentially spaced identical clips. However, other well-known arrangements may be used to accomplish the desired purpose.

Therefore upon upward movement of arm 52 after engagement with a pan 36, pan 36 is freed from the vertical stack and carried upward by the horizontal portion 53 of arm 52.

It should be pointed out that other means for conveying a food pan to the oven structure could be advantageously employed without departing from the present invention, including horizontal conveying means or a combination of horizontal and vertical conveying means using conventional means well-known to those skilled in the art.

Cooking compartment 30 preferably includes a loading station, an RF cooking station, an infra-red cooking station, and an unloading station. In order to properly and quickly cook a food product which must be browned or crisped on the outside, it must include at least one RF station to quickly heat and cook the product and an infra-red cooking station to brown or crisp the outside of the food product. Preferably, suitable exhaust fans or the like aligned with one or more openings, not shown, are provided in cooking compartment 30 to prevent the excessive build-up of heat within outer housing 20.

One advantage of having a separate loading and unloading station is to shorten the time for the total delivery of the cooked product between the time the customer actuates the apparatus and delivery of the cooked product to the customer particularly when a second order is placed closely following a prior order in an automatic vending apparatus. Another advantage relates to the more convenient implementation of handling and conveying the product through the heat component.

As best seen in FIG. 3, the four stations comprising the cooking chamber in a preferred embodiment of the present invention include a loading station, an RF cooking station, an infra-red cooking station and an unloading station, generally indicated at 64, 66, 68 and 70 respectively.

A second carousel-type rotary conveying means, in the form of a rotatably mounted platform or spider 72, is provided with open spaces or cut-outs, such as 74, which are conformed to accommodate entry of a food pan 36. The pan 36 is releasably fixed in cut-out 74 indexed to the loading station 64 via circumferentially spaced spring clips 76 essentially similar to clip 35 described earlier herein. That is, the outer lip 37 of a pan 36 rests upon or is biasly held between spaced, inwardly directed edges 78 of clips 76, but may be readily lifted free of the same edge in an upward direction. This configuration also permits the pan to be disposed in the desired position between the clips 76 from either a top or bottom entry direction.

When actuated by the logic control circuit, a food pan 36 is lifted via the action of elevator means 38 as previously described, upwardly through an opening 61 vertically aligned with loading station 66 as door 67 is also actuated to slide to an open position at this time. Elevator means 38 is controlled to raise arm 52 and a pan 36 upwardly through opening 61 and cut-out 74 in spider 72 far enough such that the outer lip or rim 37 of pan 36 is disposed upon the inner edge 78 of clips 76. Elevator means 38 then is caused to lower arm 52 and return it to its original position wherein door 67 is closed and arm 52 is rotated ninety degrees to the right as seen in FIG. 3.

Spider 72 is then caused to rotate through a selected arc to dispose the food pan 36 loaded as described at loading station 64 to the RF heating station 66 defined as being in vertical alignment between a first electrode 80 and a lift member 82. Spider 72 may be indexed or caused to rotate by any suitable conventional means such as by a driven shaft 73 operated in a similar manner as described earlier for spider 32.

Figure 4:
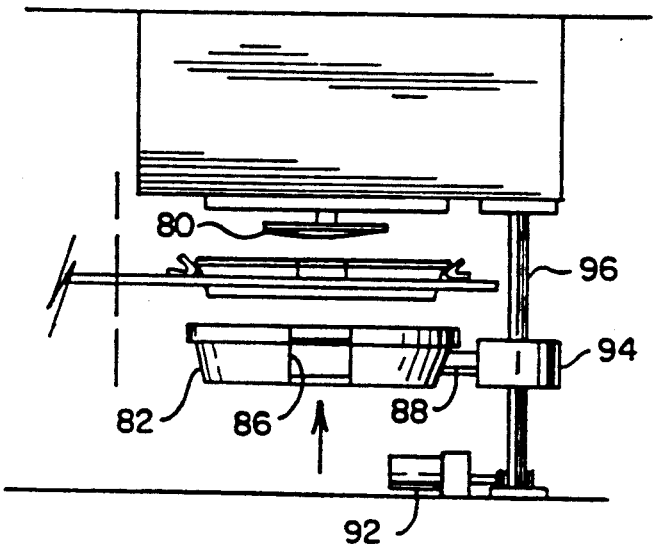
FIG. 4 is a partial side elevational view of the apparatus shown in FIG. 2 illustrating the RF heating station and the elevator means for raising a food pan from the upper rotary conveying means into a cooking position.
Figure 5:
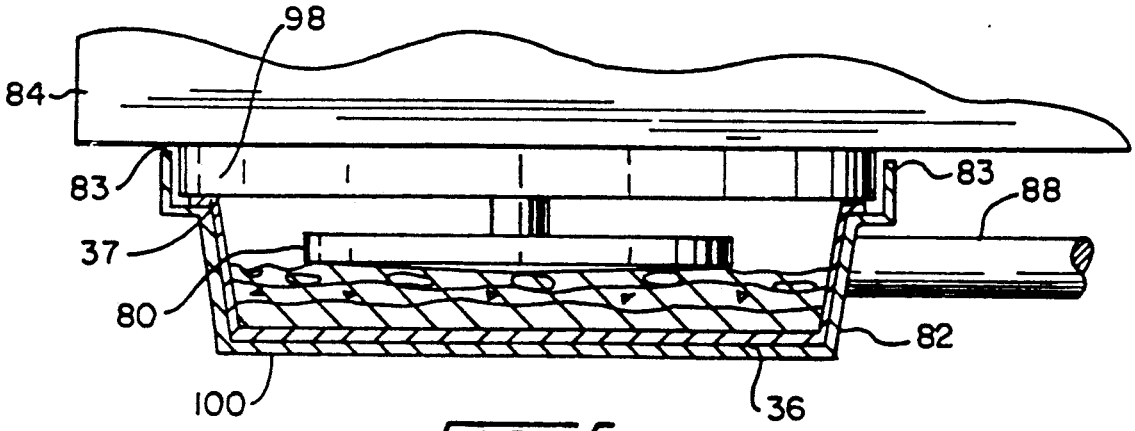
FIG. 5 is a partial view of the view shown in FIG. 4 illustrating a food pan after it is raised into a cooking position adjacent to the upper electrode.

Once a pan 36 is so positioned in RF station 66, such as seen in FIGS. 2 and 4, lift member 82 is actuated to rise and engage pan 36 and carry pan 36 upwardly to a position such as shown in FIG. 5.

Electrode 80 is operatively connected to a suitable tuning circuit and suitable conventional RF power generator, indicated diagrammatically at 85, such as those widely known and commercially available to generate RF frequencies in the range typically employed for industrial heating purposes. A frequency range of between 10 mhz and 100 mhz would appear useful in accordance with the present invention. Frequencies of 13.56 mhz and multiples thereof are more preferred as those set aside for heating purposes by the FCC. A frequency of 27.12 has been very successfully used in tests according to the present invention and accomplish very good results relative to quickly cooking food products, such as pizza.

The RF power generator 85 may be conventionally mounted within the upper portion of housing 20 and operatively connected to conventional RF tuning components mounted within an enclosure 84. These tuning components include the suitable, conventional control circuitry and components which match the impedance of the load (the capacitor formed by the electrodes and food product as the dielectric material) to the impedance of the RF power generator to obtain the most efficient power transfer. Also, appropriate microprocessors may be usefully employed and programmed to automatically adjust the power output of RF generator, diagrammatically shown at 85, to produce energy appropriate to heat the food product carried in pan 36 in a conventional manner, well known to those skilled in the art. Such microprocessors are incorporated into a conventional electronic logic control circuit diagrammatically illustrated at 87, which coordinates and controls the necessary drive means to cause the conveyance of food pans 36 through each step of the operation as it is caused to move from the storage compartment 28 and through the cooking compartment 30 in a selected preprogrammed manner and the operation of both the RF and the infra-red heating components.

Lift member 82 is configured to surround pan 36, such as shown in FIG. 5, and includes side openings, such as 86, aligned to avoid engagement between member 82 and clips 76 as it passes through opening 74.

Member 82 is mounted to an electrically non-conductive rod 88, which in turn, is mounted for vertical movement along a worm drive 90 which in turn is rotatably driven by a suitable conventional motor 92 via a conventional gear arrangement 93. Rod 88 is fixed to a collar 94 slideably mounted to a pair of guide posts 96 to provide lateral support and aid stability.

The movement of 82 is controlled via the logic circuit 87 to lift pan 36 to a position wherein rim or lip 37 engages a downwardly extending cylindrical portion 98 of enclosure 84, preferably leaving a very small amount of clearance between the upper edge 83 of member 82 and RF enclosure 84.

The depth of pan 36 and the food product 100, carried therein is designed to assure electrode 80 is closely adjacent or contacts the surface of the product 100 to obtain efficient and reasonably uniform heating thereof.

In this position, a RF dielectric heating means is formed with the electrically conductive material comprising pan 36 functioning as the ground electrode via its engagement with enclosure portion 98, electrode 80 as the high potential electrode, and the food portion 100 functioning as the dielectric material between the electrodes.

Additionally, pan 36 cooperates with the overlying surface portion 98 of enclosure 84 to form a secure RF shielding means to prevent the escape of RF waves into the surrounding environment. The preferred configuration of lifting member 82 shown also provides an additional shield as a further assurance of reducing the opportunity for escape of the RF waves generated to heat and cook food portion 100.

Upon actuation of the RF power generator 85, an essentially uniform alternating electrical field exists in the dielectric material, food portion 100, as long as the surface dimensions of the capacitor plates, i.e., electrodes 80 and pan 36, are relatively small compared to the wavelength of the radio frequency generated. These dimensions can be designed using conventional knowledge of those skilled in this art to accommodate the desirable range of food stuffs to be cooked and particularly is useful for a cooked food dispensing apparatus which requires a relatively short cooking time for practical results.

While not all foodstuffs or configurations thereof may be desirably cooked in fast, efficient coin operated food dispensers, many food products which can be conveniently placed in a metallic pan can be readily used. Pizza is a particularly good choice because of its usual, generally consistent cross-sectional thickness and represents a popular food item which lends itself to such an application in combination with an infra-red cooking station in accordance with the present invention.

After lifting member 82 has raised pan 36 into the desired position, an appropriate position sensor, not shown, actuates a control signal to actuate the RF generator to create the alternating electrical field through the dielectric material represented by the food product 100 for a selected period of time to raise the temperature thereof and cause the desired degree of cooking. After this selected time period, the RF generator is automatically shut-off and lift member 82 is caused to lower pan 36 until it is engaged by clips 76.

Then spider 72 is indexed to the next position, infra-red station 68. The control circuit then turns on the infra-red heating elements, not shown, preferably conventionally mounted in compartment 30 above and below pan 36 for a time period selected to cause the outside surface of the food product 100 to become crisp or browned to form a suitable outer crust. The temperature generated by the infra-red heating elements, their number, and positioning can be adjusted in a well-known manner to provide the desired results. Further, it is preferable to turn on the infra-red elements shortly before the pan 36 is delivered from the RF station in order to pre-heat the area of the infra-red station to shorten the cooking time.

After the selected time for cooking at the infra-red station 68 expires, spider 72 is caused to rotate to unloading station 70. At this station, an elevator means 100 and paddle arm 102, essentially similar in construction and operation to elevator means 38 and paddle arm 52, may be used to transfer pan 36 from spider 72 to one of the shelves 104 aligned with a door 26 for convenient customer access of the pan 36 carrying the cooked food product 100.

The operations of the various conveying means through their associated electrical gear motors, optical-electric position sensors, or mechanical switches may be conventionally controlled via standard electronic microprocessors in a well-known manner which also control the RF power and servo motors and associated servo controllers, which in turn, adjust the RF tuning components. These are programmed to automatically match the impedance of the load, that is, the capacitor with the pizza product as the dielectric, to the RF supply and power in the electric supply line. Appropriate electronic timing devices control the selected length of time the pan 36 remains in the RF and infra-red cooking stations and can include means which adjust the time depending upon the nature of type of the food product selected by the customer.

It has been found that a fully and properly cooked pizza portion of a practical size can be cooked and delivered in less than three minutes from the time of the customer's actuation of an apparatus constructed in accordance with the present invention.

If a second food product is ordered, it may be elevated into the RF cooking station after the first has been indexed from the RF station to the infra-red station.

The logic circuit preferably includes means to control various indicator lights, such as 24, to indicate customer selection, price, or other indicia such as providing notice to the customer that his order is ready at the delivery door.

In a similar manner, the elevator 100 via its associated drive motor 102 and paddle arrangement 102 may be controlled to deliver a cooked pizza to an unoccupied door shelf 104 if a prior cooked pizza product has not yet been removed by the customer. It should be noted that various means may be employed to obtain the necessary automatic control or provide a varied operation of the dispensing apparatus to suit various customer conveniences using well-known and conventional logic circuits within the spirit of the present invention.

However, employing an RF dielectric heating means in combination with an infra-red heating means to cook a food product in a fast and efficient manner provides a substantial improvement over prior methods and means. The problems associated with the well-known microwave energy ovens, are avoided as better control, more uniform cooking, and easier shielding is readily accomplished in accordance with the teaching of the present invention.

RF heating, properly applied, can be effective to cook food serving as the dielectric material, in a substantially more uniform manner compared to other forms of heating. Further, it has been found to be quicker and more efficient for foods having a relatively consistent cross-sectionally configuration and can usefully employ a metallic pan for cooking and serving the same. A low cost disposable aluminum foil type pan serves this purpose well in connection with the present invention and also functions as a convenient serving tray for the cooked product.

Further, the RF dielectric heating means can be conveniently and accurately controlled to optimize cooking efficiency and has provided a substantial improvement useful in automated cooking and dispensing apparatus in accordance with the present invention.

With respect to the conventional control of the automated functions of the cooking and dispensing apparatus described and merely diagrammatically illustrated at 87, various conventional means which may be employed to obtain suitable results are well-known to those of ordinary skill in the art.

The mechanical motions required for handling pans 36 may be accomplished with conventional electric gear motors. Conventional opto-electric or mechanical switches would be useful as position sensors to provide suitable signals to the logic circuit employed.

The RF power supply may be controlled by a conventional servo controller that adjusts variable capacitors via servo motors controlled by the logic circuit to automatically match the impedance of the load of the dielectric heating means (the capacitor formed by the two electrodes with the food product as the dielectric) to the RF supply and line. A conventional adjustable timer may be used to set the time interval for the RF generator and infra-red operating mode.

In prototypes of an automated machine constructed in accordance with the present invention, and RF heating interval of about 55 seconds worked very well with a pizza food product using a frequency of 27.12 mhz.

After the selected RF time interval is completed, the logic circuitry turns the RF generator off and actuates lift member 82 to lower the pan 36 back to its resting or non-cooking position on rotary conveyor or spider 72 and indexes the spider to move the pan 36 to the infra-red station 68. The infra-red radiation means is then actuated on for another times interval, such as 55 seconds which works well with a pizza product. A given cooking temperature is conveniently maintained by intermittently turning the infra-red source means on and off in a conventional manner.

After the infra-red heating cycle is complete, spider 72 is again indexed to move to unloading station 70 and elevator 100 and paddle arm 102 are activated to lift the pan 36 carrying a cooked pizza to the level of an available shelf 104. Upon retraction of the paddle arm 102, pan 36 is deposited on a shelf 104. The logic circuit, preferably, could then actuate an indicator light which would display a number beside the door 26 indicating a numerical indicator associated with a particular customer order, and release the door 26 to open for retrieval of the pan 36 deposited on the aligned shelf 104.

Of course, various options could be included in the electronic logic circuit as desired which provide suitably for the appropriate coin-actuating functions, various displays of information to the customer, and for desirable timing sequences of the conveying means to consecutive orders in the most time efficient manner. The circuitry and components to accomplish such functions ar well-known to those of ordinary skill in the electronic control art.

The design of the RF heating components would be optimized to the requirements of the food products to be cooked. For example, electrode 80 is generally round and somewhat smaller in diameter than the interior of pan 36. Therefore nearly all of the cross-sectional area of the pizza product 100 is subjected to the uniform field generated which results in very adequate degree of relatively uniform cooking of the product, particularly in view of the additional cooking accomplished at the infra-red station which crisps the outer surfaces and edges.

Other foods products, particularly those having relatively uniform cross sections could be usefully cooked in the apparatus described herein in a very fast and efficient manner practical for quick serve dispensing machine applications.

I claim:

1. An oven comprising, in combination;

a) a housing having a bottom closure; side walls, a top wall and a selectively closable inlet and outlet opening;

b) at least a first dielectric heating station disposed in said housing and including a high voltage electrode;

c) at least a second heating station disposed in said housing in spaced relationship to said first heating station and including infra-red radiation means for generating infra-red radiation;

d) first conveying means mounted in said housing including means to releasably carry at least one electronically conductive food support element for conveying said support element from said first heating station to said second heating station;

e) means mounted in said housing for causing relative movement of said food support element disposed on said first conveying means and said high voltage electrode to define a cooking position with said support element forming a ground electrode cooperating with said high voltage electrode and a food product disposed on said support element between said electrodes to form a dielectric heating means at said first cooking station;

f) a RF power generator operably associated with said dielectric heating means; and g) an electronic circuit including logic control elements operatively connected to said first conveying means, said means defined in paragraph (e), said RF power generator, and said infra-red radiation means for selectively moving said first conveying means and said means defined in paragraph (e) in a timed sequence coordinated with actuating a heating cycle for said dielectric and infra-red heating means to cook a food product.

2. An oven as defined in claim 1 wherein said means defined in paragraph (e) includes means to engage and vertically move a food support element carried by said first conveying means between a non-cooking position disposed on said first conveying means and a cooking position elevated from said first conveying means to a position closely adjacent to said first electrode at a selectively spaced distance, said distance being selected to cause an outer rim portion of said food support element to engage an upper shield surface included within said housing to cooperatively form an effective RF shielding means for containment of the RF field generated between said electrodes.

3. The oven defined in claim 1 including inlet conveying means to deliver a food support element to said first conveying means and outlet conveying means to deliver a food support element from said first conveying means to said outlet opening of said housing.

4. The oven as defined in claim 1 wherein said housing includes a storage compartment for food support elements carrying a food product and a cooking compartment, said first and second heating means and said means defined in paragraphs (d) and (e) being disposed in said cooking compartment; and including a second conveying means for transfer of a food support element from said storage compartment to said first conveying means.

5. The oven defined in claim 1 wherein said first conveying means includes a horizontal surface provide with a plurality of openings configured to releasably engage an outer rim portion of said food support element and a rotatable driven shaft operatively to said horizontal support surface for rotating said openings between said first and second heating stations.

6. The oven defined in claim 4 wherein said storage compartment is disposed in vertically aligned relationship with said cooking compartment and said second conveying means includes a vertically moving elevator provided with means to selectively and releasably engage one of a plurality of food support elements disposed in said storage compartment for vertical transfer to said first conveying means.

7. In an automated vending machine for cooking and serving selected items of food, the combination of: an outer housing including an inlet and outlet opening and;

a) a first compartment for storing a plurality of electrically conductive food support element, each carrying a food product;

b) a second compartment disposed in spaced alignment relative to said first inner chamber, said second inner chamber including a rotary conveyor conformed to releasably carry at least one of said food support elements and selectively movable between at least a first cooking station and a second cooking station, each of said stations being separated from one another in radially spaced relationship;

c) first conveying means for transferring said food support element from said first compartment to said rotary conveyor of said second compartment;

d) said first cooking station including an upper surface shield portion, a first electrode supported a selected distance below said upper shield portion and above said rotary conveying means, and third conveying means for engaging and selectively moving a food support element between a first non-cooking position on said rotary conveyor and a second cooking position selectively spaced relative to said first electrode, said food support element forming a second electrode with a food product on said food support element between said first and second electrodes forming a dielectric material for a dielectric heating means;

e) a RF power generator mounted in said outer container and operatively connected to said electrodes to create a high frequency field through said food product;

f) an infra-red radiation means disposed in said second cooking station;

g) fourth conveying means disposed in said second compartment for selectively engaging and moving a food support element from said second heating station to said outlet opening for retrieval from outside of said outer housing; and h) logic circuit means associated with said outer housing including control means operatively connected with each of said conveying means and said dielectric and infra-red heating means to selectively cause the movement of said food support elements from said first compartment to second compartment, between said cooking and non-cooking positions at said first heating station, and between said first and second cooking stations and the heating capacity of each of said heating means as said food support elements are conveyed to each of said heating stations.

* * * * *